US009010620B2

(12) United States Patent
Sutherland et al.

(10) Patent No.: US 9,010,620 B2
(45) Date of Patent: Apr. 21, 2015

(54) CARTON WITH HANDLE

(71) Applicant: Graphic Packaging International, Inc., Atlanta, GA (US)

(72) Inventors: Robert L. Sutherland, Kennesaw, GA (US); Raymond S. Kastanek, Kennesaw, GA (US); Raymond R. Spivey, Sr., Mableton, GA (US); Neil Lettre, Marietta, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 13/956,531

(22) Filed: Aug. 1, 2013

(65) Prior Publication Data

US 2014/0042215 A1 Feb. 13, 2014

Related U.S. Application Data

(60) Provisional application No. 61/742,441, filed on Aug. 10, 2012.

(51) Int. Cl.

| | |
|---|---|
| ***B65D 5/468*** | (2006.01) |
| ***B65B 43/00*** | (2006.01) |
| ***B65D 71/36*** | (2006.01) |

(52) U.S. Cl.

CPC ..... *B65D 5/4608* (2013.01); *B65B 43/00* (2013.01); *B65D 71/36* (2013.01); *B65D 2571/00141* (2013.01); *B65D 2571/0045* (2013.01); *B65D 2571/00524* (2013.01); *B65D 2571/00543* (2013.01); *B65D 2571/00549* (2013.01); *B65D 2571/0066* (2013.01); *B65D 2571/00728* (2013.01)

(58) Field of Classification Search

USPC ..... 229/117.15, 117.18, 920, 117.09; 206/141, 428; 493/88

See application file for complete search history.

(56) References Cited

U.S. PATENT DOCUMENTS

| | | | |
|---|---|---|---|
| 1,253,193 | A | 1/1918 | Hill |
| 2,372,351 | A | 3/1945 | Arneson |
| 2,383,183 | A | 8/1945 | Fischer |

(Continued)

FOREIGN PATENT DOCUMENTS

| | | |
|---|---|---|
| CA | 740 309 | 8/1966 |
| CA | 877 792 | 8/1971 |

(Continued)

OTHER PUBLICATIONS

International Search Report and Written Opinion for PCT/US2013/053158 dated Nov. 4, 2013.

*Primary Examiner* — Christopher Demeree

(74) *Attorney, Agent, or Firm* — Womble Carlyle Sandridge & Rice, LLP

(57) ABSTRACT

A carton for containing a plurality of articles. The carton comprises a plurality of panels that extends at least partially around an interior of the carton. The plurality of panels comprises at least one top panel and a reinforcement panel. A single phase handle extends in the at least one top panel and the reinforcement panel. The single phase handle can comprise at least one grip portion extending adjacent a handle opening on one side of the at least one grip portion. The handle opening can comprise a first opening in the at least one top panel and a second opening in the reinforcement panel. The second opening can be generally aligned with the first opening.

38 Claims, 7 Drawing Sheets

(56) References Cited

U.S. PATENT DOCUMENTS 2,482,399 A 9/1949 Bullock
2,594,376 A 4/1952 Arneson
2,681,143 A * 6/1954 Guyer ..... 206/427
2,702,144 A 2/1955 Forrer
2,797,856 A 7/1957 Jaeschke
2,810,506 A 10/1957 Kessler
2,851,210 A 9/1958 Kramer et al.
2,868,433 A 1/1959 Anderson, Jr.
2,896,838 A 7/1959 Struble
2,955,739 A 10/1960 Collura
3,094,268 A 6/1963 Swanson et al.
3,112,856 A 12/1963 MacIntosh et al.
3,127,720 A 4/1964 Gentry et al.
3,204,814 A 9/1965 Mahon
3,204,815 A 9/1965 Weiss
3,300,119 A 1/1967 Chaussadas
3,309,005 A 3/1967 Pilger
3,334,767 A 8/1967 Cornelius et al.
3,355,012 A 11/1967 Weiss
3,367,557 A 2/1968 Farguhar
3,371,846 A 3/1968 Detzel
3,381,881 A 5/1968 Granz et al.
3,797,729 A 3/1974 Holmes
3,827,550 A 8/1974 Arneson
3,828,926 A 8/1974 Rossi
3,886,901 A 6/1975 Zeitler
3,894,681 A 7/1975 Arneson et al.
3,904,036 A 9/1975 Forrer
3,933,303 A 1/1976 Kirby, Jr.
3,955,748 A 5/1976 Calvert
3,994,432 A 11/1976 Kirby, Jr.
4,029,204 A 6/1977 Manizza
4,032,218 A 6/1977 Scheffer
4,036,423 A 7/1977 Gordon
4,093,116 A 6/1978 Watkins et al.
4,096,985 A 6/1978 Wood
4,111,306 A 9/1978 Roccaforte
4,215,781 A 8/1980 Humphries et al.
4,216,861 A 8/1980 Oliff
4,318,474 A 3/1982 Hasegawa
4,327,829 A 5/1982 Hughes
4,328,923 A 5/1982 Graser
4,329,923 A 5/1982 Iida
4,331,289 A 5/1982 Killy
4,364,509 A 12/1982 Holley et al.
4,375,258 A 3/1983 Crayne et al.
4,378,905 A 4/1983 Roccaforte
4,382,505 A 5/1983 Sutherland et al.
4,396,143 A 8/1983 Killy
4,405,078 A 9/1983 Dutcher et al.
4,418,864 A 12/1983 Nielsen
4,424,901 A 1/1984 Lanier
4,440,340 A 4/1984 Bakx
4,447,004 A 5/1984 House et al.
4,478,334 A 10/1984 Graser
4,498,581 A 2/1985 Dutcher
4,498,619 A 2/1985 Roccaforte
4,508,258 A 4/1985 Graser
4,538,759 A 9/1985 Dutcher
4,545,485 A 10/1985 Oliff
4,546,914 A 10/1985 Roccaforte
4,577,799 A 3/1986 Oliff
4,588,084 A 5/1986 Holley, Jr.
4,653,686 A 3/1987 Wood et al.
4,706,876 A 11/1987 Wilson
4,712,728 A 12/1987 Schuster
4,747,487 A 5/1988 Wood
4,784,266 A 11/1988 Chaussadas
4,784,316 A 11/1988 Crouch
4,802,583 A 2/1989 Calvert et al.
4,830,267 A 5/1989 Wilson
4,838,479 A 6/1989 Wood
4,875,586 A 10/1989 Chaussadas
4,966,324 A 10/1990 Steel
4,989,778 A 2/1991 Saulas
5,020,337 A 6/1991 Krieg
5,060,792 A 10/1991 Oliff
5,072,876 A 12/1991 Wilson
5,094,359 A 3/1992 DeMars et al.
5,106,014 A 4/1992 Miller
5,119,985 A 6/1992 Dawson et al.
5,197,598 A 3/1993 Stout et al.
5,221,041 A 6/1993 Stout et al.
5,221,042 A 6/1993 Oliff
5,222,658 A 6/1993 DeMaio et al.
5,234,102 A 8/1993 Schuster et al.
5,246,112 A 9/1993 Stout et al.
5,284,294 A 2/1994 Floyd
5,292,058 A 3/1994 Zoss et al.
5,297,725 A 3/1994 Sutherland
5,303,863 A 4/1994 Arasim
5,307,932 A 5/1994 Stout et al.
5,307,986 A 5/1994 Schuster
5,320,277 A 6/1994 Stout et al.
5,328,081 A 7/1994 Saulas
5,333,734 A 8/1994 Stout et al.
D350,480 S 9/1994 Sutherland
5,379,944 A 1/1995 Stout et al.
5,381,891 A 1/1995 Harris
5,385,234 A 1/1995 Stout et al.
5,395,044 A 3/1995 Stout
5,427,241 A 6/1995 Sutherland
5,427,307 A 6/1995 Campbell
5,458,234 A 10/1995 Harris
5,472,090 A 12/1995 Sutherland
5,480,091 A 1/1996 Stout
5,482,203 A 1/1996 Stout
5,485,915 A 1/1996 Harris
5,495,727 A 3/1996 Strong et al.
5,524,756 A 6/1996 Sutherland
5,551,556 A 9/1996 Sutherland
5,582,343 A 12/1996 Dalvey
5,593,027 A 1/1997 Sutherland
5,639,017 A 6/1997 Fogle
5,647,483 A 7/1997 Harris
5,669,500 A 9/1997 Sutherland
5,699,957 A 12/1997 Bin et al.
5,704,470 A 1/1998 Sutherland
5,738,273 A 4/1998 Auclair
5,739,273 A 4/1998 Engelman et al.
5,794,778 A 8/1998 Harris
5,826,782 A 10/1998 Stout
5,873,515 A 2/1999 Dunn et al.
5,878,946 A 3/1999 Frerot et al.
5,906,313 A 5/1999 Oliff
5,915,546 A 6/1999 Harrelson
5,992,733 A 11/1999 Gomes
5,996,883 A 12/1999 Bates
6,019,276 A 2/2000 Auclair
6,021,897 A 2/2000 Sutherland
6,065,590 A 5/2000 Spivey
6,085,969 A 7/2000 Burgoyne
6,105,853 A 8/2000 Lamare
6,105,854 A 8/2000 Spivey et al.
6,112,977 A 9/2000 Sutherland et al.
6,129,266 A 10/2000 Oliff et al.
6,131,803 A 10/2000 Oliff et al.
6,164,526 A 12/2000 Dalvey
6,170,741 B1 1/2001 Skolik et al.
6,227,367 B1 5/2001 Harrelson et al.
6,260,755 B1 7/2001 Bates et al.
6,302,320 B1 10/2001 Stout
D452,154 S 12/2001 Rhodes et al.
6,425,520 B1 7/2002 Peterson
6,523,739 B2 2/2003 Heeley et al.
6,536,656 B2 3/2003 Auclair et al.
6,631,803 B2 10/2003 Rhodes et al.
6,669,083 B2 12/2003 Bates
6,758,337 B2 7/2004 Chargueraud et al.
6,766,940 B2 7/2004 Negelen
6,834,793 B2 12/2004 Sutherland
6,848,573 B2 2/2005 Gould et al.
6,869,009 B2 3/2005 Sutherland et al.
6,899,221 B2 5/2005 Skolik et al.

(56) References Cited

U.S. PATENT DOCUMENTS

| | | | | |
|---|---|---|---|---|
| 6,905,066 | B2 | 6/2005 | Holley et al. | |
| 6,918,487 | B2 * | 7/2005 | Harrelson | 206/427 |
| 6,926,193 | B2 | 8/2005 | Smalley | |
| 6,945,450 | B2 | 9/2005 | Rusnock | |
| 6,968,992 | B2 | 11/2005 | Schuster | |
| 7,007,836 | B2 | 3/2006 | Smalley | |
| 7,234,596 | B2 | 6/2007 | Lebras | |
| 7,296,731 | B2 | 11/2007 | Auclair et al. | |
| 7,380,701 | B2 | 6/2008 | Fogle et al. | |
| 7,416,109 | B2 | 8/2008 | Sutherland | |
| 7,427,010 | B2 | 9/2008 | Sutherland | |
| 7,467,713 | B2 | 12/2008 | Harrelson | |
| 7,472,791 | B2 | 1/2009 | Spivey, Sr. | |
| 7,601,111 | B2 | 10/2009 | Sutherland et al. | |
| 7,699,215 | B2 | 4/2010 | Spivey, Sr. | |
| 7,712,653 | B2 | 5/2010 | DeBusk et al. | |
| 7,743,944 | B2 | 6/2010 | Ho Fung et al. | |
| 7,743,968 | B2 | 6/2010 | Theelen | |
| 7,748,603 | B2 | 7/2010 | Fogle et al. | |
| 7,757,933 | B2 | 7/2010 | Dunn | |
| 7,793,779 | B2 | 9/2010 | Spivey, Sr. et al. | |
| 7,806,314 | B2 | 10/2010 | Sutherland | |
| 8,070,052 | B2 | 12/2011 | Spivey, Sr. et al. | |
| 8,216,118 | B2 | 7/2012 | Dunn | |
| 8,348,142 | B2 | 1/2013 | Smalley | |
| 2002/0088820 | A1 | 7/2002 | Spivey | |
| 2003/0136820 | A1 | 7/2003 | Negelen | |
| 2003/0213263 | A1 | 11/2003 | Woog | |
| 2004/0050917 | A1 | 3/2004 | Smalley | |
| 2004/0074954 | A1 | 4/2004 | Fogle et al. | |
| 2005/0056658 | A1 | 3/2005 | Spivey | |
| 2005/0087592 | A1 | 4/2005 | Schuster | |
| 2005/0167478 | A1 | 8/2005 | Holley, Jr. | |
| 2006/0071058 | A1 | 4/2006 | Spivey, Sr. | |
| 2006/0169755 | A1 | 8/2006 | Spivey, Sr. | |
| 2006/0273143 | A1 | 12/2006 | Finch | |
| 2007/0029371 | A1 | 2/2007 | Theelen | |
| 2007/0039846 | A1 | 2/2007 | Spivey, Sr. | |
| 2007/0051781 | A1 | 3/2007 | Holley, Jr. | |
| 2007/0108261 | A1 | 5/2007 | Schuster | |
| 2007/0131748 | A1 | 6/2007 | Brand | |
| 2007/0164091 | A1 | 7/2007 | Fogle et al. | |
| 2007/0181658 | A1 | 8/2007 | Sutherland | |
| 2007/0205255 | A1 | 9/2007 | Dunn | |
| 2007/0284424 | A1 | 12/2007 | Holley | |
| 2007/0295789 | A1 | 12/2007 | Ho Fung | |
| 2008/0073420 | A1 | 3/2008 | Walling et al. | |
| 2008/0083820 | A1 | 4/2008 | Walling et al. | |
| 2008/0099544 | A1 | 5/2008 | Skolik | |
| 2008/0119344 | A1 | 5/2008 | Sutherland et al. | |
| 2009/0236408 | A1 | 9/2009 | Spivey, Sr. | |
| 2009/0255983 | A1 | 10/2009 | De Paula et al. | |
| 2010/0213249 | A1 | 8/2010 | Requena | |
| 2010/0237138 | A1 | 9/2010 | Bradford | |
| 2012/0012600 | A1 | 1/2012 | Gonzalez | |
| 2012/0211552 | A1 | 8/2012 | Kastanek et al. | |
| 2012/0321754 | A1 | 12/2012 | Block | |
| 2013/0146649 | A1 | 6/2013 | Spivey, Sr. et al. | |
| 2013/0186045 | A1 | 7/2013 | Kastanek et al. | |

FOREIGN PATENT DOCUMENTS

| | | | |
|---|---|---|---|
| CA | 2 160 145 | | 9/1995 |
| CH | 601 064 | | 6/1978 |
| DE | 85 14 718.4 | | 6/1985 |
| DE | 296 07 374 | | 4/1996 |
| DE | 296 13 814 | U1 | 10/1996 |
| DE | 201 12 228 | | 11/2002 |
| DE | 2004 018 649 | | 4/2005 |
| EP | 0 003 935 | | 9/1979 |
| EP | 0 412 226 | | 2/1991 |
| EP | 0 473 266 | | 3/1992 |
| EP | 1 612 157 | | 1/2006 |
| FR | 1 489 093 | | 6/1967 |
| FR | 1 494 239 | | 9/1967 |
| FR | 2 274 059 | | 1/1976 |
| FR | 2 579 175 | | 9/1986 |
| GB | 2 252 958 | | 8/1992 |
| JP | 8-503187 | | 4/1996 |
| JP | 11-501273 | A | 2/1999 |
| JP | 2005-507831 | | 3/2005 |
| KR | 20-0356729 | | 7/2004 |
| WO | WO 94/10047 | | 5/1994 |
| WO | WO 96/21604 | | 7/1996 |
| WO | WO 96/27538 | | 9/1996 |
| WO | WO 98/19932 | | 5/1998 |
| WO | WO 99/28207 | | 6/1999 |
| WO | WO 00/78618 | | 12/2000 |
| WO | WO 01/66434 | | 9/2001 |
| WO | WO 03/037742 | | 5/2003 |
| WO | WO 2005/080218 | | 9/2005 |
| WO | WO 2005/123532 | | 12/2005 |
| WO | WO 2007/089282 | | 8/2007 |
| WO | WO 2009/117562 | A1 | 9/2009 |

* cited by examiner

CARTON WITH HANDLE

CROSS-REFERENCE TO RELATED APPLICATIONS

This application claims the benefit of U.S. Provisional Patent Application No. 61/742,441, filed Aug. 10, 2012.

INCORPORATION BY REFERENCE

The disclosure of U.S. Provisional Patent Application No. 61/742,441, which was filed on Aug. 10, 2012, is hereby incorporated by reference for all purposes as if presented herein in its entirety.

BACKGROUND OF THE DISCLOSURE

The present disclosure generally relates to cartons for holding containers. More specifically, the present disclosure relates to a carton having a handle.

SUMMARY OF THE DISCLOSURE

In one aspect, the present disclosure is generally directed to a carton for containing a plurality of articles. The carton comprises a plurality of panels that extends at least partially around an interior of the carton. The plurality of panels comprises at least one top panel and a reinforcement panel. A single phase handle extends in the at least one top panel and the reinforcement panel. The single phase handle can comprise at least one grip portion extending adjacent a handle opening on one side of the at least one grip portion. The handle opening can comprise a first opening in the at least one top panel and a second opening in the reinforcement panel. The second opening can be generally aligned with the first opening.

In another aspect, the disclosure is generally directed to a blank for forming a carton for containing a plurality of articles. The blank comprises a plurality of panels comprising at least one top panel and a reinforcement panel and handle features extending in the at least one top panel and the reinforcement panel for forming a single phase handle. The handle features can comprise at least one grip portion extending adjacent a handle opening on one side of the at least one grip portion. The handle opening can comprise a first opening in the at least one top panel and a second opening in the reinforcement panel. The second opening can be for being generally aligned with the first opening when the carton is formed from the blank.

In another aspect, the disclosure is generally directed to a method for forming a carton for containing a plurality of articles. The method comprises obtaining a blank comprising a plurality of panels comprising at least one top panel and a reinforcement panel, and handle features extending in the at least one top panel and the reinforcement panel. The handle features can comprise at least one grip portion, a first opening in the at least one top panel, and a second opening in the reinforcement panel. The method further can comprise forming an interior of the carton at least partially defined by the plurality of panels. The forming the interior of the carton can comprise forming an open-ended sleeve. The method also can comprise forming a single phase handle comprising the handle features. The forming the single phase handle can comprise at least generally aligning the second opening with the first opening to form a handle opening on one side of the at least one grip portion. The at least one grip portion can extend adjacent the handle opening.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present invention generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons according to the present invention can accommodate articles of any shape. For the purpose of illustration and not for the purpose of limiting the scope of the invention, the following detailed description describes beverage containers (e.g., aluminum beverage cans) as disposed within the carton embodiments. In this specification, the terms "lower," "bottom," "upper," and "top" indicate orientations determined in relation to fully erected and upright cartons.

Figure 1:
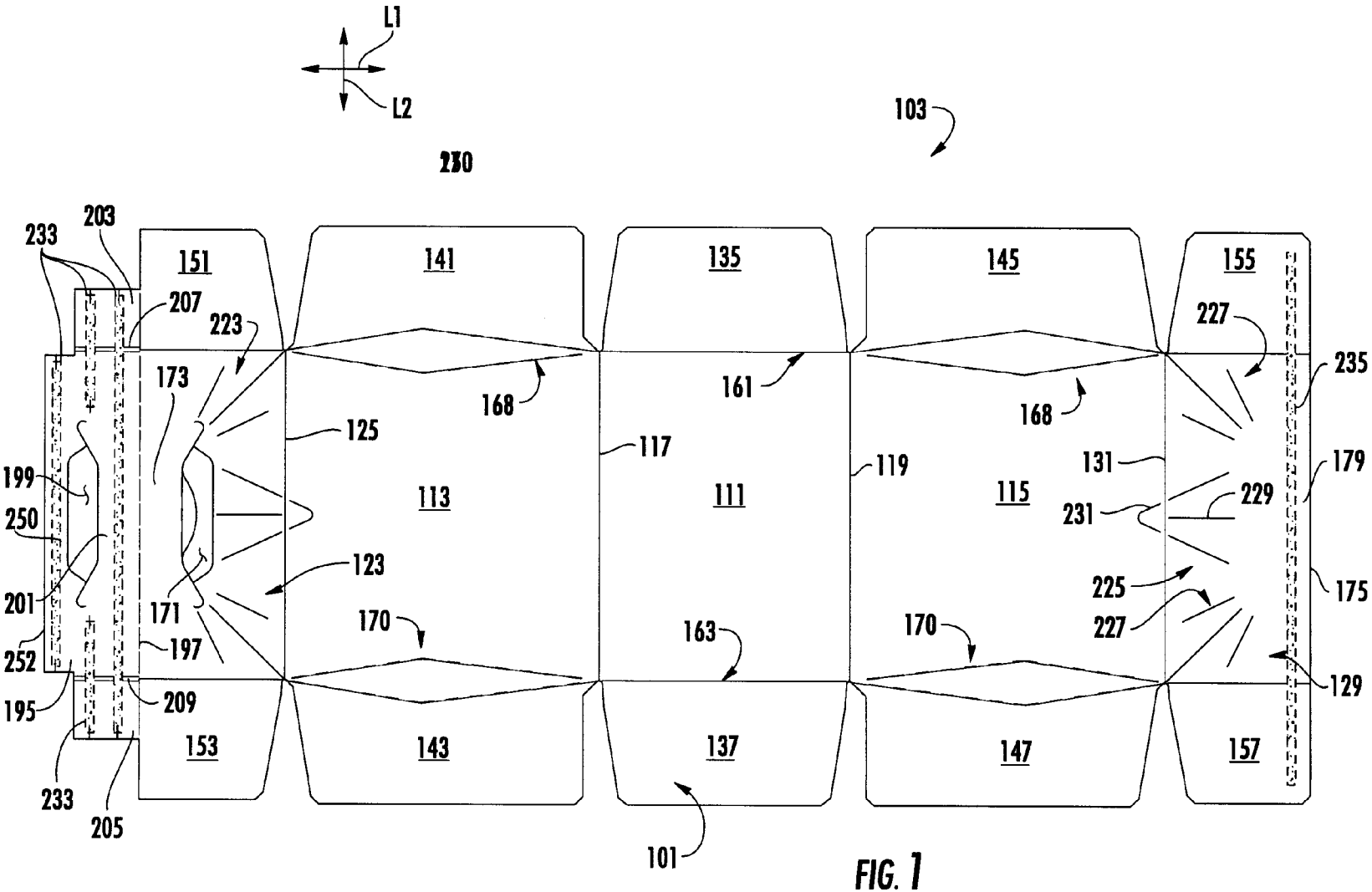
FIG. 1 is an exterior plan view of a blank for forming a carton according to a first exemplary embodiment of the disclosure.
Figure 4:
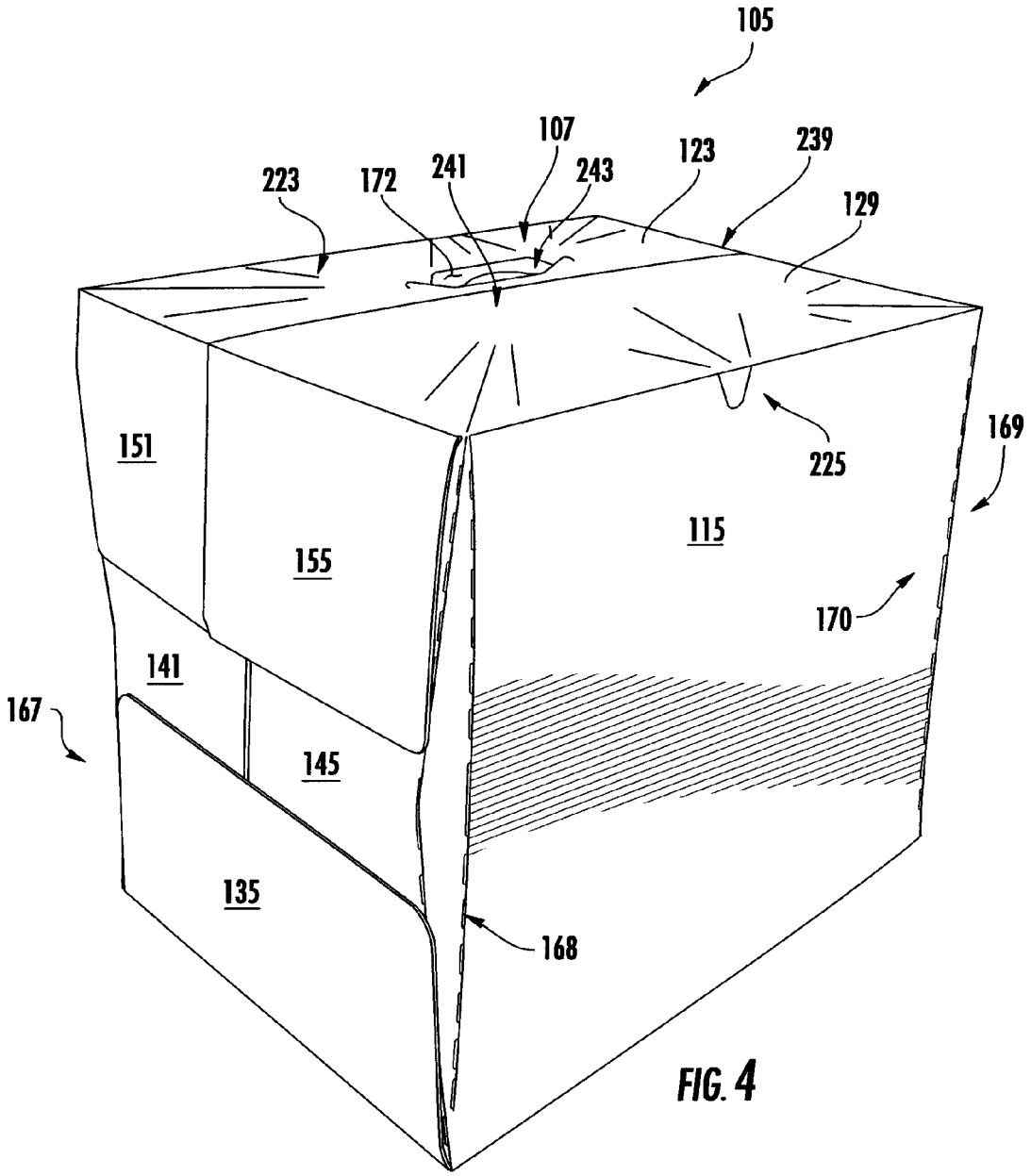
FIG. 4 is a perspective view of the carton according to the first exemplary embodiment of the disclosure.
Figure 5:
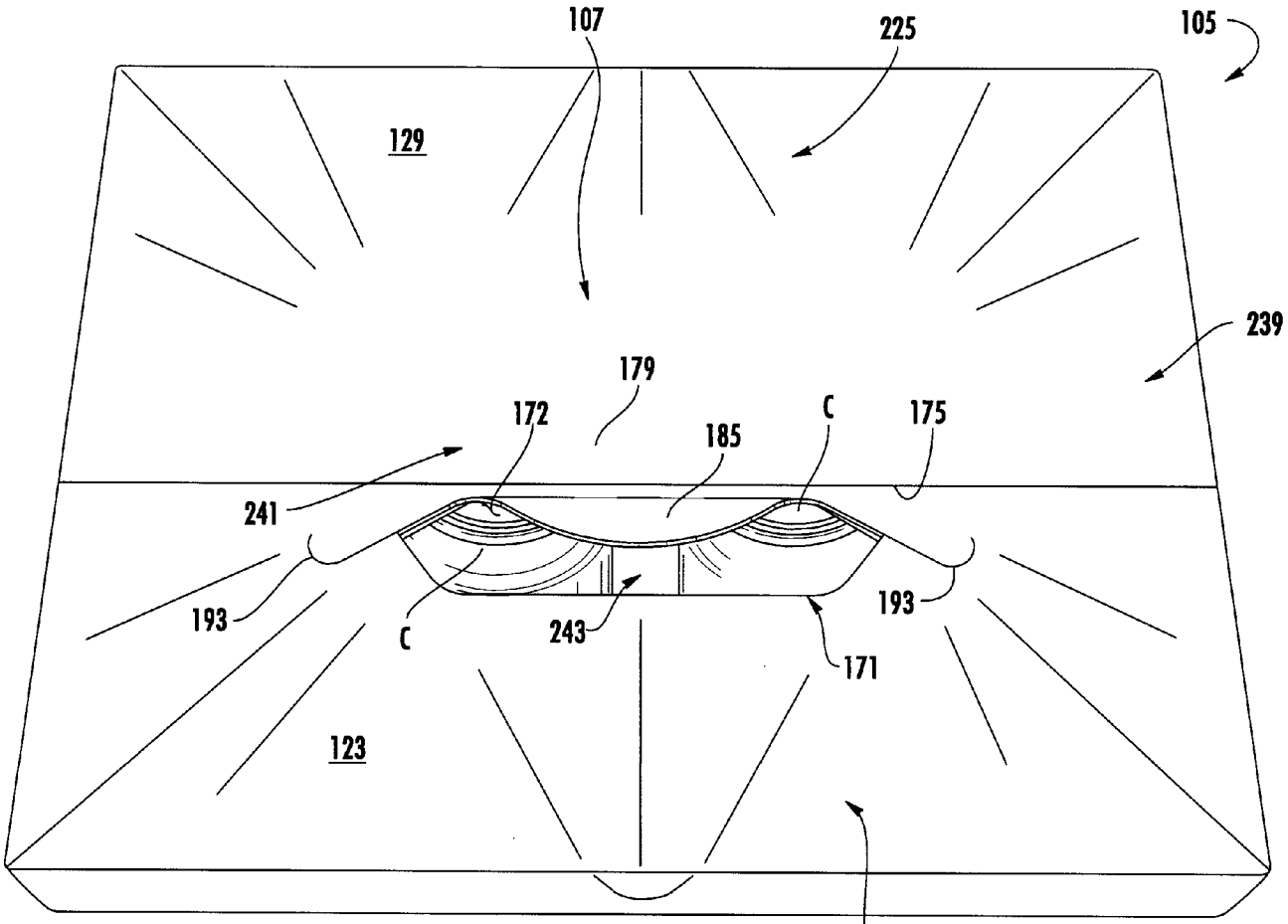
FIG. 5 is a top view of the carton of FIG. 4.

FIG. 1 is a plan view of the exterior side 101 of a blank, generally indicated at 103, used to form a carton 105 (FIGS. 4 and 5) according to one exemplary embodiment of the disclosure. The carton 105 can be used to house a plurality of articles such as containers C (FIGS. 4 and 5). The carton 105 has a handle, generally indicated at 107 (FIGS. 4 and 5), for grasping and carrying the carton. In one illustrated embodiment, the carton 105 is sized to house twenty-four containers C in two layers in a 3×4 arrangement, but it is understood that the carton may be sized and shaped to hold containers of a different or same quantity in a single layer, more than two layers, and/or in different row/column arrangements (e.g., 1×6, 3×6, 2×6, 4×6, 2×6×2, 3×4×2, 2×9, 3×5, 3×5×2, etc.). In the illustrated embodiment, the containers C are cans, but other types of containers (e.g., bottles) can be used in the carton 105.

The blank 103 has a longitudinal axis L1 and a lateral axis L2. The blank 103 comprises a bottom panel 111 foldably connected to first and second side panels 113, 115 at respective lateral fold lines 117, 119, a first top panel 123 foldably connected to the first side panel 113 at a lateral fold line 125, and a second top panel 129 foldably connected to the second side panel 115 at a lateral fold line 131. In the illustrated embodiment, the first and second top panels 123, 129 can at least partially overlap in the erected carton 105.

The bottom panel 111 is foldably connected to a first bottom end flap 135 and a second bottom end flap 137. The first side panel 113 is foldably connected to a first side end flap 141 and a second side end flap 143. The second side panel 115 is foldably connected to a first side end flap 145 and a second side end flap 147. The first top panel 123 is foldably connected to a first top end flap 151 and a second top end flap 153. The second top panel 129 is foldably connected to a third top end flap 155 and a fourth top end flap 157.

The end flaps 135, 141, 145, 151, 155 extend along a first marginal area of the blank 103, and are foldably connected at a first longitudinal fold line 161 that extends along the length of the blank. The end flaps 137, 143, 147, 153, 157 extend along a second marginal area of the blank 103, and are foldably connected at a second longitudinal fold line 163 that also extends along the length of the blank. The longitudinal fold lines 161, 163 may be, for example, substantially straight, offset, or oblique at one or more locations to account for blank thickness or for other factors. When the carton 105 is erected, the end flaps 135, 141, 145, 151, 155 close a first end 167 of the carton, and the end flaps 137, 143, 147, 153, 157 close a second end 169 of the carton. In accordance with an alternative embodiment of the present invention, different flap arrangements can be used for closing the ends 167, 169 of the carton 105.

In the illustrated embodiment, the blank 103 includes two diamond-shaped corners, generally indicated at 168, at the first end 167 of the carton 105 and two diamond-shaped corners 170 at the second end 169 of the carton. The diamond corners 168, 170 can help the carton 105 at least partially conform to the shape of the containers C in the corners of the carton. In the illustrated embodiment, the side panels 113, 115 and the ends 167, 169 extend generally vertically in the carton 105. Alternatively, a top wall 239 (FIGS. 3-5) formed by the top panels 123, 129 in the carton 105 can be shorter than the bottom panel 111 in the lateral direction L2 and/or the longitudinal direction L1 so that some or all of each end 167, 169 of the carton and/or each side panel 113, 115 can be angled inwardly. The fold lines 161, 163 and diamond corners 168, 170 could be omitted or otherwise shaped, arranged, positioned, and/or configured without departing from the disclosure.

Figure 1A:
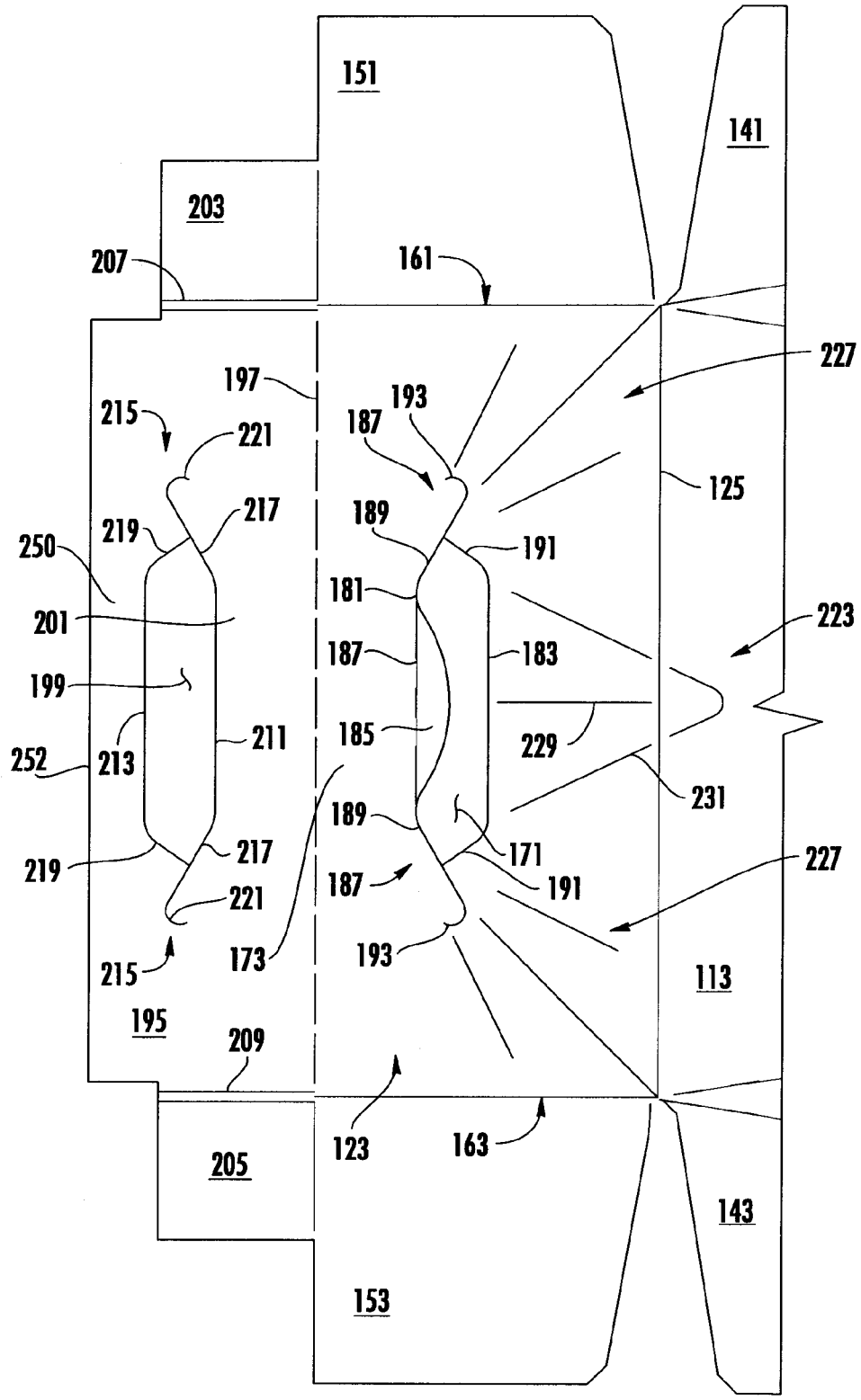
FIG. 1A is a detail plan view of a top panel of the blank of FIG. 1.

As shown in FIGS. 1 and 1A, the handle features that comprise the handle 107 include a first opening 171 in the first top panel 123 for forming a portion of a handle opening 172 (FIG. 5) and a first handle portion 173 (e.g., a grip portion) in the first top panel 123 adjacent to the first opening 171. As shown in FIG. 1, the features that comprise the handle 107 also comprise a second handle portion 179 (e.g., a grip portion) that is in the second top panel 129 adjacent to a laterally-extending free edge 175 of the blank 103. In the illustrated embodiment, as shown in FIG. 1A, the first opening 171 has an elongated shape for receiving at least a portion of a user's hand (e.g., four fingers). Accordingly, the first opening 171 comprises a first lateral edge 181 and a second lateral edge 183. A comfort flap 185 can be foldably connected to the first handle portion 173 along a fold line 185, which can be collinear with the first lateral edge 181. In the illustrated embodiment, the ends 187 of the first opening 171 can include features for helping to control and/or for direct the lifting forces on the handle in the first top panel 123. Accordingly, each end 187 comprises a first oblique edge 189 extending from an end of the first lateral edge 181, a second oblique edge 191 extending from an end of the second lateral edge 183 to the first oblique edge 189, and a cut line 193 (e.g., a hook-shaped cut) extending from an end of the first oblique edge 189. The cut lines 193 can form tear stops in the top panel 123 to help prevent unwanted tearing of the top panel 123 when the carton 105 is lifted and/or supported at the handle 107. The handle features including the first opening 171 and the handle portions 173, 179 could be omitted or otherwise shaped, arranged, and/or configured without departing from the disclosure. For example, the handle features could include a handle flap foldably connected to the top panel adjacent the first opening 171 in an alternative embodiment.

Figure 2:
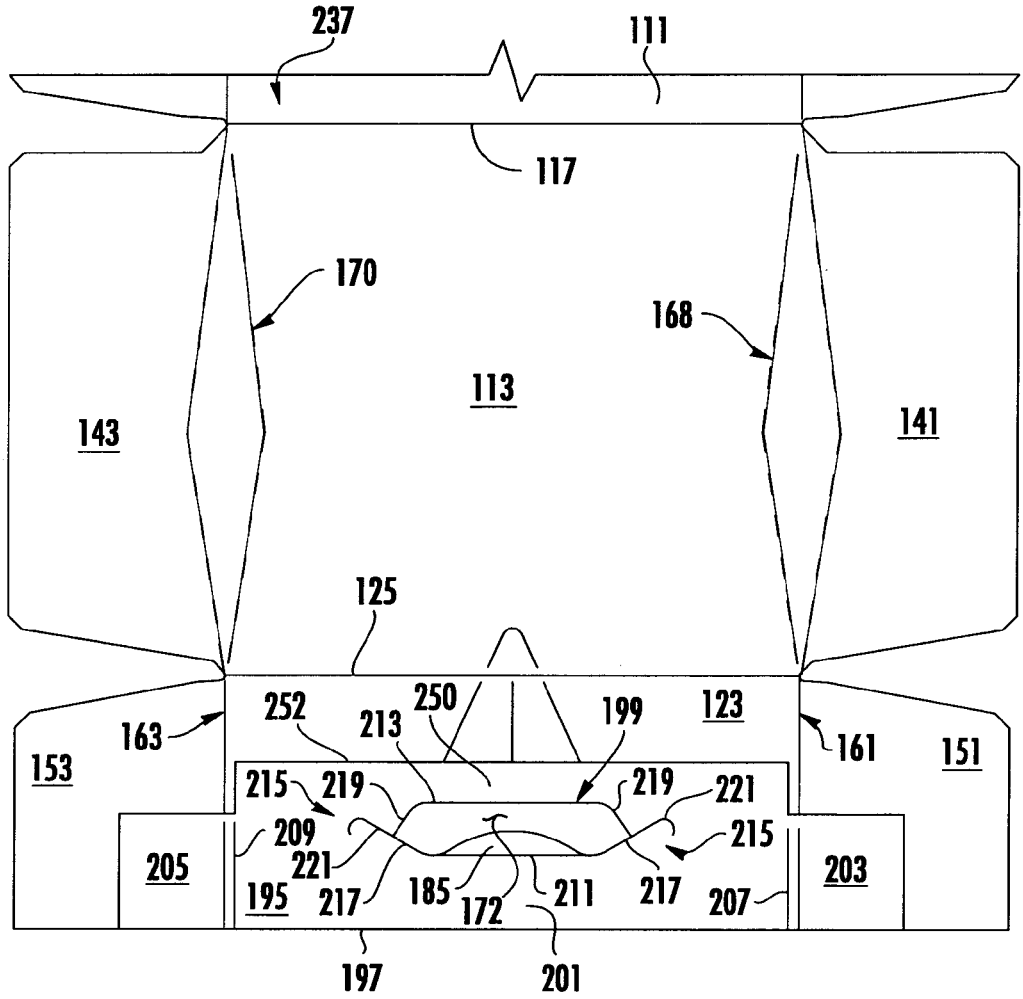
FIGS. 2 and 3 are perspective views showing the formation of a partially assembled carton according to the first exemplary embodiment of the disclosure.

In the illustrated embodiment, a handle reinforcement panel 195 can be foldably connected to the first top panel 123 along a lateral fold line 197 (FIGS. 1 and 1A). The handle reinforcement panel 195 can include a second opening 199 for forming a portion of the handle opening 172 (FIG. 5) and a third handle portion 201 (e.g., a reinforcing grip portion) adjacent to the second opening 199 and the first handle portion 173. In one embodiment, reinforcing end flaps 203, 205 can be foldably connected to the handle reinforcement panel 195 along respective longitudinal fold lines 207, 209. As shown in FIG. 1A, the fold lines 207, 209 can comprise multiple creases, scores, and/or other fold line types that are aligned with and/or collinear with the respective longitudinal fold lines 161, 163. The reinforcing end flaps 203, 205 can be foldably connected to the respective top end flaps 151, 153 along the lateral fold line 197. Alternatively, the reinforcing end flaps could be separated from the top end flaps 151, 153 by cut lines or could be spaced apart from the top end flaps. When the carton 105 is formed, the handle reinforcement panel 195 and the reinforcing end flaps 203, 205 can be folded into face-to-face contact with an interior surface of the respective first top panel 123 and top end flaps 155, 157 to help reinforce the first top panel 123, including the handle 107 (FIGS. 2 and 5), and the top end flaps 155, 157. In the illustrated embodiment, the second opening 199 and the third handle portion 201 are generally aligned with the respective first opening 171 and first handle portion 173 when the handle reinforcement panel 195 is in face-to-face contact with the first top panel 123 (FIG. 2). The handle reinforcement panel 195 could be otherwise shaped, arranged, and/or configured and could have a second opening 199 and/or handle portion 201 that is alternatively shaped, arranged, and/or configured without departing from the disclosure. Further, the handle reinforcement panel 195, the second opening 199, and/or the handle portion 201 could be omitted without departing from the disclosure.

As shown in FIG. 1A, the second opening 199 can be substantially identical or similar in shape as the first opening 171. Accordingly, the second opening 199 has an elongated shape for receiving at least a portion of a user's hand (e.g., four fingers) when the handle reinforcement panel 195 is overlapped by the first top panel 123 and the second opening 199 is aligned with the first handle opening 171. The second opening 199 comprises a first lateral edge 211 and a second lateral edge 213. In the illustrated embodiment, the ends 215 of the second opening 199 can include features for helping to control and/or direct the lifting forces on the handle in the handle reinforcement panel 195. Accordingly, each end 215 comprises a first oblique edge 217 extending from an end of the first lateral edge 211, a second oblique edge 219 extending from an end of the second lateral edge 213 to the first oblique edge 217, and a cut line 221 (e.g., a hook-shaped cut) extending from an end of the first oblique edge 217. The cut lines 221 can form tear stops in the handle reinforcement panel 195 to help prevent unwanted tearing of the handle reinforcement panel 195 when the carton 105 is lifted and/or supported at the handle 107. The second opening 199 and the handle portion 201 could be omitted or otherwise shaped, arranged, and/or configured without departing from the disclosure. For example, the second opening 199 could be a different shape than the first opening 171. The second opening 199 could be a simpler or a more complex shape than the first opening 171, and/or could be larger or smaller than the first opening 171 in one or more directions (e.g., shorter in the lateral direction L2, wider in the longitudinal direction L1, etc.). Further the handle features could include a handle flap and/or a comfort flap foldably connected to the handle reinforcement panel 195 adjacent the second handle opening 199 in an alternative embodiment.

In the illustrated embodiment, the reinforcement panel 195 can include a distal portion 250 (e.g., on the opposite side of the handle opening 199 from the grip portion 201) that is partially defined by the second lateral edge 213 and an outer free edge 252 of the reinforcement panel 195. As shown in FIGS. 1 and 1A, the outer edge 252 can extend in the lateral direction L2. In one embodiment, the distal portion 250 is adhered in face-to-face contact with an interior surface of the first top panel 123. The reinforcement panel 195, the distal portion 250, and/or the outer edge 252 could be omitted or otherwise shaped, arranged, and/or configured without departing from the disclosure.

In the illustrated embodiment, the blank 103 comprises force-directing scores 223, 225 extending in at least the respective top panels 123, 129. As shown in FIGS. 1 and 1A, the force-directing scores 223 include oblique end scores 227 extending from proximate the cut lines 193 generally toward the corners of the first top panel 123 where the lateral fold line 125 intersects the respective longitudinal fold lines 161, 163. The force-directing scores 223 can also include a longitudinal score 229 bisecting a V-shaped score 231, which extends into the first side panel 113. The V-shaped score 231 can be interrupted so that it is spaced apart from the lateral fold line 125 on either side of the lateral fold line 125. As shown in FIG. 1, the force-directing scores 225 in the second top panel 129 can be substantially identical or similar to the force-directing scores 223 in the first top panel 123. Accordingly, the force-directing scores 225 can include oblique end scores 227, a longitudinal score 229, and a V-shaped score 231. Alternatively, the force-directing scores 225 can be omitted or differently shaped, arranged, and/or configured than the force-directing scores 223. The force-directing scores 223, 225 can cause the top panels 123, 129 to deform to predetermined shapes when the carton 105 is carried at the handle 107 to help prevent tearing of the carton 105 and/or to help provide a shape that is easier for a user to carry. The force-directing scores 223, 225 could be otherwise shaped, arranged, and/or configured without departing from the disclosure. For example, the force-directing scores 223, 225 could be creases, cut-creases, fold lines, or other forms of weakening. Additionally, the blank 103 can include additional force-directing and/or stress-relieving creases and patterns. Further, the force-directing creases 223, 225 could be omitted without departing from the disclosure.

In one embodiment, the blank 103 can include features for forming dispensers (not shown) in the carton 105. The dispenser can extend in the top panels 123, 129, the side panels 113, 115, the bottom panel 111, and/or the ends 167, 169 of the carton 105.

Figure 3:
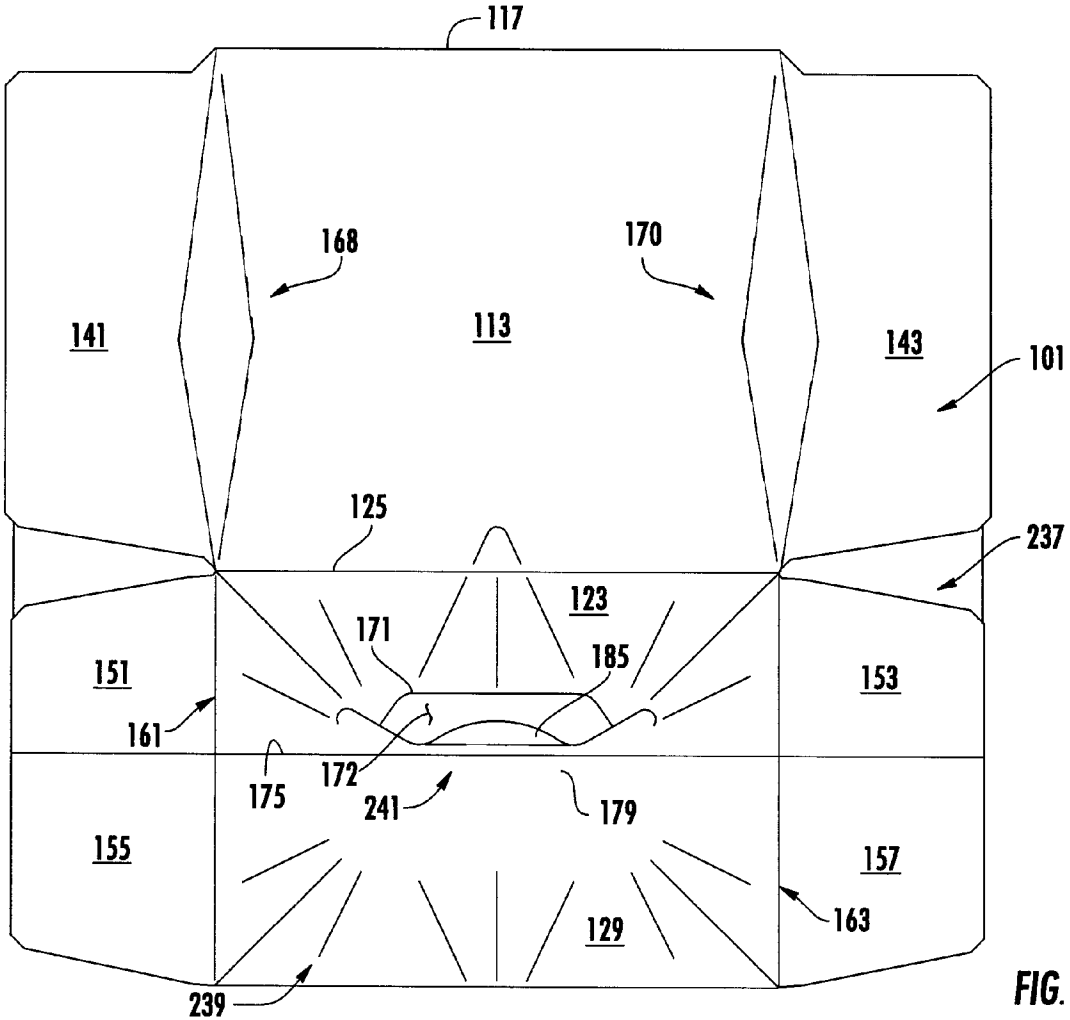

An exemplary method of erecting the carton 105 is discussed in detail below and shown in FIGS. 2 and 3. At various stages of the erecting process, glue or other adhesive can be applied to various portions of the blank 103. For example, one or more glue strips 233 (drawn in phantom in FIG. 1) can be applied to the interior surface of the handle reinforcement panel 195 and the reinforcing end flaps 203, 205 as shown in FIG. 1 for adhering the handle reinforcement panel 195 and the reinforcing end flaps 203, 205 to the interior surfaces of the respective first top panel 123 and top end flaps 151, 153 (FIG. 2). Also, one or more glue strips 235 (drawn in phantom in FIG. 1) can be applied to the interior surface of the second top panel 129 and the top end flaps 155, 157 as shown in FIG. 1 for adhering the second top panel 129 and the top end flaps 155, 157 to the exterior surface of the respective first top panel 123 and top end flaps 151, 153 (FIG. 3). The glue strips 233, 235 could be otherwise shaped, arranged, and/or configured without departing from the disclosure. For example, the glue strips 233 could be applied to the interior surface of the first top panel 123 instead of, or in addition to, the handle reinforcement panel 195, and the glue strip 235 could be applied to the exterior surface of the first top panel 123 instead of, or in addition to, the second top panel 129. Further, the glue strips 233, 235 could be omitted without departing from the disclosure.

As shown in FIG. 2, the blank 103 is first positioned with the exterior surface 101 facing down and the interior surface 237 facing up (opposite from the position shown in FIG. 1 with the exterior surface facing up). The handle reinforcement panel 195 is folded about the lateral fold line 197 to be in face-to-face contact with the first top panel 123 with the end flaps 203, 205 being in face-to-face contact with the respective top end flaps 151, 153 and the third handle portion 201 in face-to-face contact with the first handle portion 173 (FIG. 2). Accordingly, the glue strips 233 can help secure the interior surface of the handle reinforcement panel 195 and the end flaps 203, 205 to the first top panel 123 and the top end flaps 151, 153. In the illustrated embodiment, when the handle reinforcement panel 195 is folded, the second handle opening 199 can be generally aligned with the first handle opening 171 in the first top panel 123.

In one embodiment, the carton 105 is further formed by folding the first top panel 123, with the folded under and attached reinforcement panel 195, and the first side panel 113 about fold line 117 to the position shown in FIG. 3. Next, the second top panel 129 can be folded about fold line 131 so that the second top panel 129 at least partially overlaps and is adhesively secured to the first top panel 123 by the glue strip 235 (FIG. 1) to form a top wall 239 (FIG. 3). In one embodiment, the second handle portion 179 of the second top panel 129 overlaps and is adhesively secured to the first handle portion 173 of the first top panel 123, which, in turn, overlaps and is adhesively secured to the third handle portion 201 of the handle reinforcement panel 195 to form a three-ply grip portion 241 of the handle 107 (FIGS. 3-5). The top wall 239 and the handle 107 could be formed by other forming steps and features without departing from the disclosure.

In the illustrated embodiment, the partially assembled carton can be assembled into an open-ended sleeve (not shown) by folding along the lateral fold lines 117, 119, 125, 131 to dispose the top wall 239 generally opposite to the bottom panel 111 so that containers C can be loaded into an interior 243 of the carton 105 (FIGS. 4 and 5). The ends 167, 169 of the carton 105 can be closed by at least partially overlapping and adhering the end flaps 135, 141, 145, 151, 155, 203 at the first end 167 and at least partially overlapping and adhering the end flaps 137, 143, 147, 153, 157, 205 at the second end 169. For example, the first end 167 can be closed by folding the side end flaps 141, 145 inwardly over the end of the carton and downwardly folding and securing the overlapped top end flaps 151, 155 and reinforcing end flap 203 to the side end flaps 141, 145. The bottom end flap 135 can be upwardly folded and secured to the side end flaps 141, 145 before or after securing the top end flaps 151, 155 and reinforcing end flap 203. The containers C can be loaded into the sleeve before closing the ends 167, 169, or after closing either of the ends 167, 169. The erected carton is shown in FIG. 4. The ends 167, 169 of the carton 105 could be closed by other closing steps and features and/or alternatively loaded without departing from the disclosure.

In the illustrated embodiment, the handle 107 is formed from the handle features of the blank 103 and comprises three layers of blank material at the grip portion 241 (the first handle portion 173, the second handle portion 179, and the handle reinforcement portion 201). Additionally, when the handle 107 is formed in the illustrated embodiment, the distal portion 250 of the reinforcement panel 195 is in face-to-face contact with a portion of the first top panel 123 that is opposite to the first handle portion 173 so that the handle opening 172 (including the aligned openings 171, 199) is generally surrounded by portions of the first top panel 123 and the reinforcement panel 195. The handle 107 could have other features and could include additional reinforcing layers or portions without departing from the disclosure. The handle 107 could be otherwise formed without departing from the disclosure. For example, the handle reinforcement flap 181 could be omitted and/or the top wall 239 could be replaced by a single top panel, wherein the first opening 171 can extend in the single top panel with a grip portion in the single top panel adjacent the first opening 171.

In one embodiment, the carton 105 can be lifted at the handle 107 by inserting at least a portion of a hand into the interior of the carton through the handle opening 172 (the aligned openings 171, 199) and grasping the three-ply grip portion 241. The user's hand can contact the interior surface of the top wall 239, including the handle reinforcement flap 181 and/or the second top panel 129 when lifting the carton at the handle. In the illustrated embodiment, the three-ply grip portion 241 extends into the ends 167, 169 of the carton (where the top end flaps 151, 155 overlap the reinforcing end flap 203 and the top end flaps 153, 157 overlap the reinforcing end flap 205) so that the grip portion can help carry the lifting force on the handle to the ends of the carton. Additionally, the oblique end scores 227 in the top panels 123, 129 can help direct the forces in the top panels 123, 129 to the corners of the carton 105 to help prevent tearing of the top panels. The longitudinal scores 229 and the V-shaped scores 231 also can help control the deformation of the top panels 123, 129 and the side panels 113, 115 to help prevent unwanted tearing of the carton 105. The cut lines 193, 221 extending in the respective first top panel 123 and handle reinforcement flap 181 from the respective handle openings 171, 199 can also help prevent unwanted tearing of the first top panel 123 and the handle reinforcement flap 181 by forming tear stops in the top wall 239.

Figure 6:
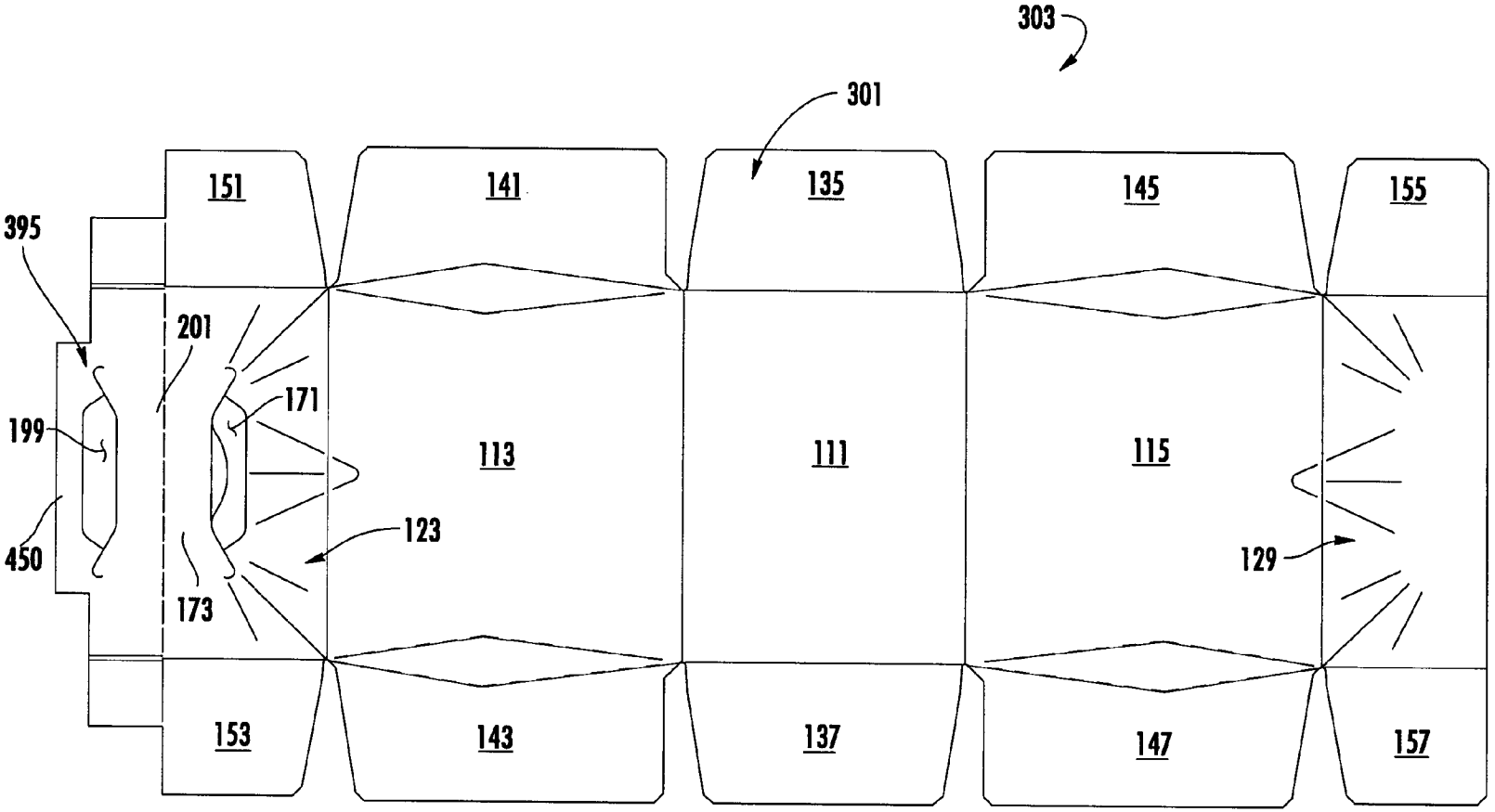
FIG. 6 is an exterior plan view of a blank for forming a carton according to a second exemplary embodiment of the disclosure.

In the illustrated embodiment, the handle 107 is a generally asymmetric or single phase handle wherein the grip portion 241 extends adjacent a single handle opening 170 formed by the aligned openings 171, 199 (e.g., a handle opening extends on one side of the grip portion). The second top panel 129 lacks a handle opening. Accordingly, less material is removed from the top wall 239 to form handle openings. However, the user is still able to easily grasp the handle 107 to lift and carry the carton 105. The single phase handle 107 could be otherwise shaped, arranged, and/or configured without departing from the disclosure FIG. 6 is a plan view of an exterior surface 301 of an alternative blank 303 for forming a carton (not shown) according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 6, the blank 303 includes an alternative handle reinforcement panel 395 with a distal portion 450 (e.g., on the opposite side of the handle opening 199 from the grip portion 201) that extends only part way between the longitudinal fold lines 207, 209 in the lateral direction L2. In contrast, the distal portion of the handle reinforcement panel 195 of the first embodiment (FIG. 1) extends substantially the entire lateral width of the handle reinforcement panel 195. The handle reinforcement panel 395 and the blank 303 could be otherwise shaped, arranged, and/or configured without departing from the disclosure.

It is noted that the handle features of the various embodiments can be incorporated into a carton having any suitable carton style or panel configuration. The carton styles and panel configurations described above are included by way of example.

The blanks according to the present invention can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks.

In accordance with the exemplary embodiments, the blanks may be constructed of paperboard of a caliper such that it is heavier and more rigid than ordinary paper. The blanks can also be constructed of other materials, such as cardboard, hard paper, or any other material having properties suitable for enabling the carton package to function at least generally as described above. The blanks can also be laminated to or coated with one or more sheet-like materials at selected panels or panel sections.

The above embodiments may be described as having one or more panels adhered together by glue. The term "glue" is intended to encompass all manner of adhesives commonly used to secure carton panels or flaps in place.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a plurality of articles, the carton comprising:

a plurality of panels that extends at least partially around an interior of the carton, the plurality of panels comprising at least one top panel and a reinforcement panel, the at least one top panel comprising at least a first top panel and a second top panel; and a single phase handle extending in the at least one top panel and the reinforcement panel, the single phase handle comprising at least one grip portion extending adjacent a handle opening on one side of the at least one grip portion, the at least one grip portion comprising at least a first grip portion extending in the first top panel, the handle opening comprising a first opening extending in the first top panel and a second opening in the reinforcement panel, the second opening being generally aligned with the first opening;

wherein the second top panel is free of any handle openings.

2. The carton of claim 1, wherein the at least one grip portion further comprises a reinforcing grip portion extending in the reinforcement panel.

3. The carton of claim 2, wherein the first grip portion of the first top panel at least partially overlaps the reinforcing grip portion of the reinforcement panel.

4. The carton of claim 1, wherein the reinforcement panel is foldably connected to the first top panel along a fold line.

5. The carton of claim 1, wherein the at least one grip portion comprises at least a first grip portion in the at least one top panel and a reinforcing grip portion in the reinforcement panel.

6. The carton of claim 1, wherein the at least one top panel comprises a first lateral edge extending adjacent the first opening and a first oblique edge extending from each end of the first lateral edge adjacent the first opening, and a first hook-shaped cut extends from each of the first oblique edges.

7. The carton of 6, wherein the at least one top panel comprises a second lateral edge extending adjacent the first opening and a second oblique edge extending from each end of the second lateral edge to a respective one of the first oblique edges adjacent the first opening.

8. The carton of claim 1, further comprising at least two end flaps respectively foldably attached to respective panels of the plurality of panels, wherein the end flaps are overlapped with respect to one another and thereby at least partially form a closed end of the carton, the at least two end flaps comprising at least one top end flap foldably connected to the at least one top panel and at least one reinforcing end flap foldably connected to the reinforcement panel.

9. The carton of claim 8, wherein the at least one reinforcing end flap is at least partially in face-to-face contact with the at least one top end flap.

10. The carton of claim 8, wherein the at least one reinforcing end flap is foldably connected to the at least one top end flap.

11. The carton of claim 10, wherein the at least one top end flap comprises at least a first top end flap foldably connected to the first top panel and a second top end flap foldably connected to the second top panel, the second top end flap at least partially overlaps the first top end flap, and the first top end flap at least partially overlaps the at least one reinforcing end flap.

12. The carton of claim 1, wherein the reinforcement panel comprises a distal portion extending adjacent the second opening and an outer edge of the reinforcement panel, the distal portion being at least partially in face-to-face contact with the at least one top panel.

13. The carton of claim 1, wherein the single phase handle comprises a handle flap foldably connected to the at least one grip portion adjacent the handle opening.

14. A carton for containing a plurality of articles, the carton comprising:

a plurality of panels that extends at least partially around an interior of the carton, the plurality of panels comprising at least one top panel and a reinforcement panel foldably attached to the at least one top panel; and a single phase handle extending in the at least one top panel and the reinforcement panel, the single phase handle comprising at least one grip portion extending adjacent a handle opening on one side of the at least one grip portion, the handle opening comprising a first opening in the at least one top panel and a second opening in the reinforcement panel, the second opening being generally aligned with the first opening;

wherein the at least one grip portion comprises at least a first grip portion in the at least one top panel and a reinforcing grip portion in the reinforcement panel, and the first grip portion at least partially overlaps the reinforcing grip portion.

15. The carton of claim 14, wherein the at least one top panel comprises a first lateral edge and a second lateral edge, each extending adjacent the first opening, and the reinforcement panel comprises a third lateral edge and a fourth lateral edge, each extending adjacent the second opening.

16. The carton of claim 15, wherein the reinforcement panel comprises a distal portion at least partially defined by the fourth lateral edge and an outer edge of the reinforcement panel.

17. The carton of claim 15, wherein each of the first grip portion and the reinforcing grip portion is at least partially defined by the respective first lateral edge and third lateral edge.

18. A carton for containing a plurality of articles, the carton comprising:

a plurality of panels that extends at least partially around an interior of the carton, the plurality of panels comprising at least one top panel and a reinforcement panel foldably attached to the at least one top panel; and a single phase handle extending in the at least one top panel and the reinforcement panel, the single phase handle comprising at least one grip portion extending adjacent a handle opening on one side of the at least one grip portion, the handle opening comprising a first opening in the at least one top panel and a second opening in the reinforcement panel, the second opening being generally aligned with the first opening;

wherein the at least one top panel comprises a first lateral edge extending adjacent the first opening and a first oblique edge extending from each end of the first lateral edge adjacent the first opening, and a first hook-shaped cut extends from each of the first oblique edges; and wherein the reinforcement panel comprises a second lateral edge extending adjacent the second opening and a second oblique edge extending from each end of the second lateral edge adjacent the second opening, a second hook-shaped cut extends from each of the second oblique edges, and each of the second lateral edge, the second oblique edges, and the second hook-shaped cuts in the reinforcement panel is generally aligned with the respective first lateral edge, first oblique edges, and first hook-shaped cuts in the at least one top panel.

19. The carton of claim 18, wherein the at least one top panel comprises a third lateral edge extending adjacent the first opening and a third oblique edge extending from each end of the third lateral edge to a respective one of the first oblique edges adjacent the first opening, the reinforcement panel comprises a fourth lateral edge extending adjacent the second opening and a fourth oblique edge extending from each end of the fourth lateral edge to a respective one of the second oblique edges adjacent the second opening, and each of the fourth lateral edge and the fourth oblique edges of the reinforcement panel is generally aligned with the respective third lateral edge and third oblique edges of the at least one top panel.

20. A blank for forming a carton for containing a plurality of articles, the blank comprising:

a plurality of panels comprising at least one top panel and a reinforcement panel, the at least one top panel comprising at least a first top panel and a second top panel; and handle features extending in the at least one top panel and the reinforcement panel for forming a single phase handle, the handle features comprising at least one grip portion extending adjacent a handle opening on one side of the at least one grip portion, the at least one grip portion comprises at least a first grip portion extending in the first top panel, the handle opening comprising a first opening extending in the first top panel and a second opening in the reinforcement panel, the second opening for being generally aligned with the first opening when the carton is formed from the blank;

wherein the second top panel is free of any handle openings.

21. The blank of claim 20, wherein the at least one grip portion further comprises a reinforcing grip portion extending in the reinforcement panel.

22. The blank of claim 21, wherein the first grip portion of the first top panel is for at least partially overlapping the reinforcing grip portion of the reinforcement panel when the carton is formed from the blank.

23. The blank of claim 20, wherein the reinforcement panel is foldably connected to the first top panel along a fold line.

24. The blank of claim 20, wherein the at least one top panel comprises a first lateral edge extending adjacent the first opening and a first oblique edge extending from each end of the first lateral edge adjacent the first opening, and a first hook-shaped cut extends from each of the first oblique edges.

25. The blank of 24, wherein the at least one top panel comprises a second lateral edge extending adjacent the first opening and a second oblique edge extending from each end of the second lateral edge to a respective one of the first oblique edges adjacent the first opening.

26. The blank of claim 20, further comprising at least two end flaps respectively foldably attached to respective panels of the plurality of panels, wherein the end flaps are for being overlapped with respect to one another when the carton is formed from the blank and thereby at least partially form a closed end of the carton formed from the blank, the at least two end flaps comprising at least one top end flap foldably connected to the at least one top panel and at least one reinforcing end flap foldably connected to the reinforcement panel.

27. The blank of claim 26, wherein the at least one reinforcing end flap is foldably connected to the at least one top end flap.

28. The blank of claim 20, wherein the reinforcement panel comprises a distal portion extending adjacent the second opening and an outer edge of the reinforcement panel, and the distal portion is for being positioned at least partially in face-to-face contact with the at least one top panel when the carton is formed from the blank.

29. The blank of claim 20, wherein the handle features comprise a handle flap foldably connected to the at least one grip portion adjacent the handle opening.

30. A blank for forming a carton for containing a plurality of articles, the blank comprising:

a plurality of panels comprising at least one top panel and a reinforcement panel foldably attached to the at least one top panel; and handle features extending in the at least one top panel and the reinforcement panel for forming a single phase handle, the handle features comprising at least one grip portion extending adjacent a handle opening on one side of the at least one grip portion, the handle opening comprising a first opening in the at least one top panel and a second opening in the reinforcement panel, the second opening for being generally aligned with the first opening when the carton is formed from the blank;

wherein the at least one grip portion comprises at least a first grip portion in the at least one top panel and a reinforcing grip portion in the reinforcement panel, and the first grip portion is for at least partially overlapping the reinforcing grip portion when the carton is formed from the blank.

31. The blank of claim 30, wherein the at least one top panel comprises a first lateral edge and a second lateral edge, each extending adjacent the first opening, and the reinforcement panel comprises a third lateral edge and a fourth lateral edge, each extending adjacent the second opening.

32. The blank of claim 31, wherein the reinforcement panel comprises a distal portion at least partially defined by the fourth lateral edge and an outer edge of the reinforcement panel.

33. The blank of claim 31, wherein each of the first grip portion and the reinforcing grip portion is at least partially defined by the respective first lateral edge and third lateral edge.

34. A blank for forming a carton for containing a plurality of articles, the blank comprising:

a plurality of panels comprising at least one top panel and a reinforcement panel; and handle features extending in the at least one top panel and the reinforcement panel for forming a single phase handle, the handle features comprising at least one grip portion extending adjacent a handle opening on one side of the at least one grip portion, the handle opening comprising a first opening in the at least one top panel and a second opening in the reinforcement panel, the second opening for being generally aligned with the first opening when the carton is formed from the blank;

wherein the at least one top panel comprises a first lateral edge extending adjacent the first opening and a first oblique edge extending from each end of the first lateral edge adjacent the first opening, and a first hook-shaped cut extends from each of the first oblique edges; and wherein the reinforcement panel comprises a second lateral edge extending adjacent the second opening and a second oblique edge extending from each end of the second lateral edge adjacent the second opening, a second hook-shaped cut extends from each of the second oblique edges, and each of the second lateral edge, the second oblique edges, and the second hook-shaped cuts in the reinforcement panel is for being generally aligned with the respective first lateral edge, first oblique edges, and first hook-shaped cuts in the at least one top panel when the carton is formed from the blank.

35. The blank of claim 34, wherein the at least one top panel comprises a third lateral edge extending adjacent the first opening and a third oblique edge extending from each end of the third lateral edge to a respective one of the first oblique edges adjacent the first opening, the reinforcement panel comprises a fourth lateral edge extending adjacent the second opening and a fourth oblique edge extending from each end of the fourth lateral edge to a respective one of the second oblique edges adjacent the second opening, and each of the fourth lateral edge and the fourth oblique edges of the reinforcement panel is for being generally aligned with the respective third lateral edge and third oblique edges of the at least one top panel when the carton is formed from the blank.

36. A method of forming a carton, comprising:

obtaining a blank comprising a plurality of panels comprising at least one top panel and a reinforcement panel, and handle features extending in the at least one top panel and the reinforcement panel, the at least one top panel comprising at least a first top panel and a second top panel, the handle features comprising at least one grip portion, a first opening extending in the first top panel, and a second opening in the reinforcement panel, the at least one grip portion comprises at least a first grip portion extending in the first top panel, wherein the second top panel is free of any handle openings;

forming an interior of the carton at least partially defined by the plurality of panels, the forming the interior of the carton comprising forming an open-ended sleeve; and forming a single phase handle comprising the handle features, the forming the single phase handle comprising at least generally aligning the second opening with the first opening to form a handle opening on one side of the at least one grip portion, the at least one grip portion extending adjacent the handle opening.

37. The method of claim 36, wherein the at least one grip portion further comprises a reinforcing grip portion extending in the reinforcement panel, and the forming the single phase handle further comprises positioning the first grip portion of the first top panel to at least partially overlap the reinforcing grip portion in the reinforcement panel.

38. The carton of claim 36, wherein the reinforcement panel comprises a distal portion extending adjacent the second opening and an outer edge of the reinforcement panel, the forming the open-ended sleeve comprising folding the reinforcement panel relative to the at least one top panel so that at least the distal portion is at least partially in face-to-face contact with the at least one top panel.

* * * * *